US009717315B2

(12) United States Patent
Horino

(10) Patent No.: US 9,717,315 B2
(45) Date of Patent: Aug. 1, 2017

(54) EYELASH CURLER AND ADDITIONAL MEMBER FOR EYELASH CURLER

(71) Applicant: NOBLE CO., LTD., Tokyo (JP)

(72) Inventor: Keiko Horino, Tokyo (JP)

(73) Assignee: NOBLE CO., LTD., Tokyo (JP)

( * ) Notice: Subject to any disclaimer, the term of this patent is extended or adjusted under 35 U.S.C. 154(b) by 0 days.

(21) Appl. No.: 14/397,857

(22) PCT Filed: Nov. 6, 2013

(86) PCT No.: PCT/JP2013/080003

§ 371 (c)(1),
(2) Date: Oct. 29, 2014

(87) PCT Pub. No.: WO2014/077161

PCT Pub. Date: May 22, 2014

(65) Prior Publication Data

US 2015/0122285 A1 May 7, 2015

(30) Foreign Application Priority Data

Nov. 13, 2012 (JP) ..... 2012-249596

(51) Int. Cl.
*A45D 2/48* (2006.01)
*A45D 24/02* (2006.01)

(52) U.S. Cl.
CPC ..... *A45D 2/48* (2013.01); *A45D 24/02* (2013.01); *A46B 2200/1053* (2013.01)

(58) Field of Classification Search
CPC . A45D 2/48; A45D 8/12; A45D 24/02; A45D 24/04; A45D 24/30; A45D 24/34;
(Continued)

(56) References Cited

U.S. PATENT DOCUMENTS 2,242,349 A * 5/1941 Dailey ..... A45D 2/42 132/122
2,292,494 A * 8/1942 Tupper ..... A45D 24/02 132/112

(Continued)

FOREIGN PATENT DOCUMENTS

GB 714134 A * 8/1954 ..... A45D 2/48
JP 2008516645 A 5/2008

(Continued)

OTHER PUBLICATIONS

Translated Office Action Patent Application No. JP-2012-249596; Sep. 2, 2014.

*Primary Examiner* — Robyn Doan
(74) *Attorney, Agent, or Firm* — Renaissance IP Law Group, LLP; David A. Crowther

(57) ABSTRACT

Embodiments of the present invention provide an eyelash curler capable of separating eyelashes from each other at roots thereof and of beautifully curling eyelashes. The eyelash curler 1 has a pair of frame portions 12 and 12 extending in a vertical direction, a movable member 60 that is movable in the vertical direction along the pair of frame portions 12 and 12, a stationary member 50 fixed above the movable member 60, and an elastic member 70 placed on the movable member 60. The eyelash curler 1 has arm members 10 and 20 operable to move the movable member 60 upward to bring the contact area 70A of the elastic member 70 into contact with the stationary member 50 and a comb member 80 attached to the movable member 60. The comb member 80 includes an attachment portion 81 attached to a front surface of the movable member 60, a bridge portion 82 extending from the attachment portion 81 to near the contact area 70A of the elastic member 70, and a plurality of tooth-shaped portions 83 extending upward from portions of the bridge portion 82 that are located near the
(Continued)

contact area 70A of the elastic member 70. The tooth-shaped portions 83 are spaced at certain intervals in a horizontal direction.

12 Claims, 7 Drawing Sheets

(58) Field of Classification Search
CPC .... A45D 2024/345; A45D 24/00; A41G 5/02; A46B 2200/1053; A46B 2200/106
See application file for complete search history.

(56) References Cited

U.S. PATENT DOCUMENTS 2,444,937 A * 7/1948 Marcellus ..... A45D 2/48 132/217
2,569,246 A * 9/1951 Marcellus ..... A45D 2/48 132/217
2,611,375 A * 9/1952 Bablon ..... A45D 40/26 132/120
2,635,611 A * 4/1953 Marcellus ..... A45D 2/48 132/217
3,491,725 A * 1/1970 Maniscalco ..... A01K 13/002 119/625
4,212,311 A * 7/1980 del Valle ..... A45D 2/48 132/217
2001/0037815 A1* 11/2001 Gueret ..... A46D 1/0253 132/218
2003/0102005 A1* 6/2003 Muraki ..... A45D 2/48 132/217
2007/0163613 A1 7/2007 Lee
2012/0160259 A1* 6/2012 Nguyen ..... A41G 5/02 132/216

FOREIGN PATENT DOCUMENTS

JP 4119942 B1 7/2008
JP 2009078031 A 4/2009
JP 2010259539 A 11/2010
TW M473734 11/2014
WO 2006031081 A1 3/2006

* cited by examiner

EYELASH CURLER AND ADDITIONAL MEMBER FOR EYELASH CURLER

BACKGROUND

The present invention relates to an eyelash curler, and more particularly to an additional member attachable to an eyelash curler for curling eyelashes.

There have heretofore been known various kinds of eyelash curlers for curling eyelashes. However, when such a conventional eyelash curler is used to curl eyelashes, eyelashes may be curled in a state in which they adhere to each other, or may be formed into a state in which they stand upright. In order to solve such drawbacks, there has been proposed an eyelash curler having eyelash arrangement means for interposing between eyelashes when the eyelashes are sandwiched by the eyelash curler and dispersing the eyelashes to align the eyelashes (see, e.g., JP-B 4119942).

However, such an eyelash curler does not align eyelashes at roots thereof, and thus suffers from a drawback that it cannot sufficiently prevent eyelashes from adhering to each other.

SUMMARY

Embodiments of the present invention have been made in view of the above drawbacks in the prior art. Embodiments of the present invention provide an eyelash curler capable of separating eyelashes from each other at roots thereof and of beautifully curling eyelashes, and an additional member for such an eyelash curler.

According to a first aspect of the present invention, there is provided an additional member for an eyelash curler that can separate eyelashes from each other at roots thereof and can beautifully curl eyelashes. The additional member for an eyelash curler is attached to an eyelash curler having a movable member operable to move in a vertical direction. The additional member for an eyelash curler has an attachment portion attachable to the movable member, a bridge portion extending from the attachment portion, and a plurality of tooth-shaped portions extending upward from the bridge portion. The plurality of tooth-shaped portions are spaced at certain intervals in a horizontal direction.

According to a second aspect of the present invention, there is provided an eyelash curler capable of separating eyelashes from each other at roots thereof and of beautifully curling eyelashes. The eyelash curler has a pair of frame portions extending in a vertical direction, a movable member that is movable in the vertical direction along the pair of frame portions, a stationary member fixed above the movable member, and an elastic member placed on the movable member. The movable member connects between the pair of frame portions, and the stationary member connects between the pair of frame portions. The elastic member has a contact area that is brought into contact with the stationary member. The eyelash curler also has an operation portion operable to move the movable member upward to bring the contact area of the elastic member into contact with the stationary member and a comb member attached to the movable member. The comb member includes an attachment portion attached to the movable member, a bridge portion extending from the attachment portion to near the contact area of the elastic member, and a plurality of tooth-shaped portions extending upward from portions of the bridge portion that are located near the contact area of the elastic member. The plurality of tooth-shaped portions are spaced at certain intervals in a horizontal direction.

Thus, a plurality of tooth-shaped portions extend upward from the bridge portion. Therefore, when the eyelash curler is used, those tooth-shaped portions forcibly go into between roots of eyelashes. Thus, the eyelashes can be separated finely at the roots thereof. Accordingly, the eyelashes do not adhere to each other. As a result, the eyelashes can be curled beautifully from the roots thereof. Furthermore, since a plurality of tooth-shaped portions are spaced at certain intervals in the horizontal direction, the eyelashes can be curled into good-looking fan shapes spaced at certain intervals.

Each of the plurality of tooth-shaped portions of the comb member preferably has a contact surface that is substantially brought into contact with a front surface of the stationary member when the contact area of the elastic member is brought into contact with the stationary member. In this case, the tooth-shaped portions of the comb member are located so close to the stationary member that the contact surfaces are substantially brought into contact with the stationary member. Therefore, the tooth-shaped portions are positioned very close to roots of eyelashes when the eyelashes are sandwiched between the stationary member and the elastic member. Accordingly, the aforementioned effect of separating eyelashes at roots thereof can be exhibited more significantly.

Furthermore, each of the tooth-shaped portions preferably has an upper end curved forward. Since the upper end of each of the tooth-shaped portions is curved forward, the eyelash curler faces no risk that tips of the tooth-shaped portions stick in the user's eye when the eyelash curler is used. Additionally, when the movable member is moved upward, the stationary member is guided by curved surfaces of the upper ends of the tooth-shaped portions. Therefore, the stationary member is prevented from being caught on the tips of the tooth-shaped portions.

Moreover, the comb member may be attached to the outside of the movable member. In this case, the comb member can be seen from the outside of the eyelash curler. Thus, the advantageous effect of finely separating eyelashes can visually be appealed to users.

A tooth extension portion may be formed so as to extend continuously in a downward direction from the tooth-shaped portion by removal of part of the bridge portion of the comb member along adjacent tooth-shaped portions so as to extend a slit formed between the adjacent tooth-shaped portions in the downward direction. Furthermore, a groove may be formed in the attachment portion of the comb member so as to extend in the downward direction along an extension line of the slit. By forming such a tooth extension portion or groove only at part of the comb member, the height of root portions of the tooth-shaped portions or the thickness of the comb member can locally be adjusted. Therefore, a user can readily see between the elastic member and the stationary member (roots of eyelashes) when the eyelash curler is used.

A through hole may be formed in the attachment portion of the comb member so as to extend from a front surface of the attachment portion to a rear surface of the attachment portion. The movable member may have a hook portion that can be inserted into the through hole and held in engagement with the attachment portion of the comb member. In this manner, the hook portion of the movable member is inserted into the through hole of the attachment portion of the comb member and then held in engagement with the attachment portion. Therefore, the comb member can firmly be fixed on the movable member in a stable manner. Accordingly, the eyelash curler faces no risk that, for example, the comb member staggers such that the tooth-shaped portions or the like sticks in the user's eye when the eyelash curler is used.

According to embodiments of the present invention, a plurality of tooth-shaped portions extend upward from the bridge portion. Therefore, when the eyelash curler is used, those tooth-shaped portions forcibly go into between roots of eyelashes. Thus, the eyelashes can be separated finely at the roots thereof. Accordingly, the eyelashes do not adhere to each other. As a result, the eyelashes can be curled beautifully from the roots thereof. Furthermore, since a plurality of tooth-shaped portions are spaced at certain intervals in the horizontal direction, the eyelashes can be curled into good-looking fan shapes spaced at certain intervals.

DESCRIPTION OF EMBODIMENTS

Figure 1:
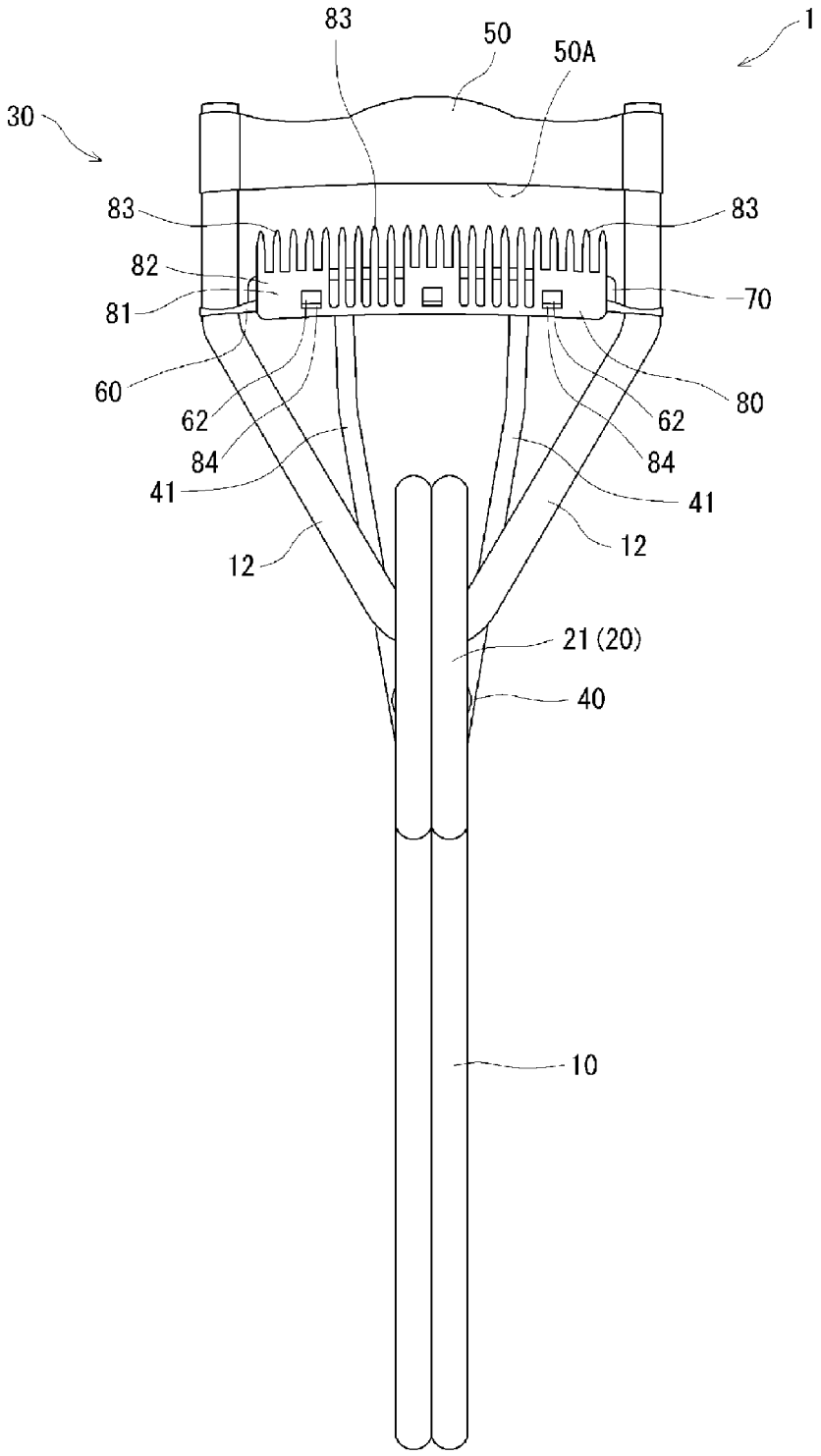
FIG. 1 is a front view showing an eyelash curler according to an embodiment of the present invention.

Embodiments of an eyelash curler according to the present invention will be described in detail with reference to FIGS. 1 to 9. In FIGS. 1 to 9, like or corresponding components are denoted by like or corresponding reference numerals, and the repetitive explanation thereof will be omitted.

Figure 2:
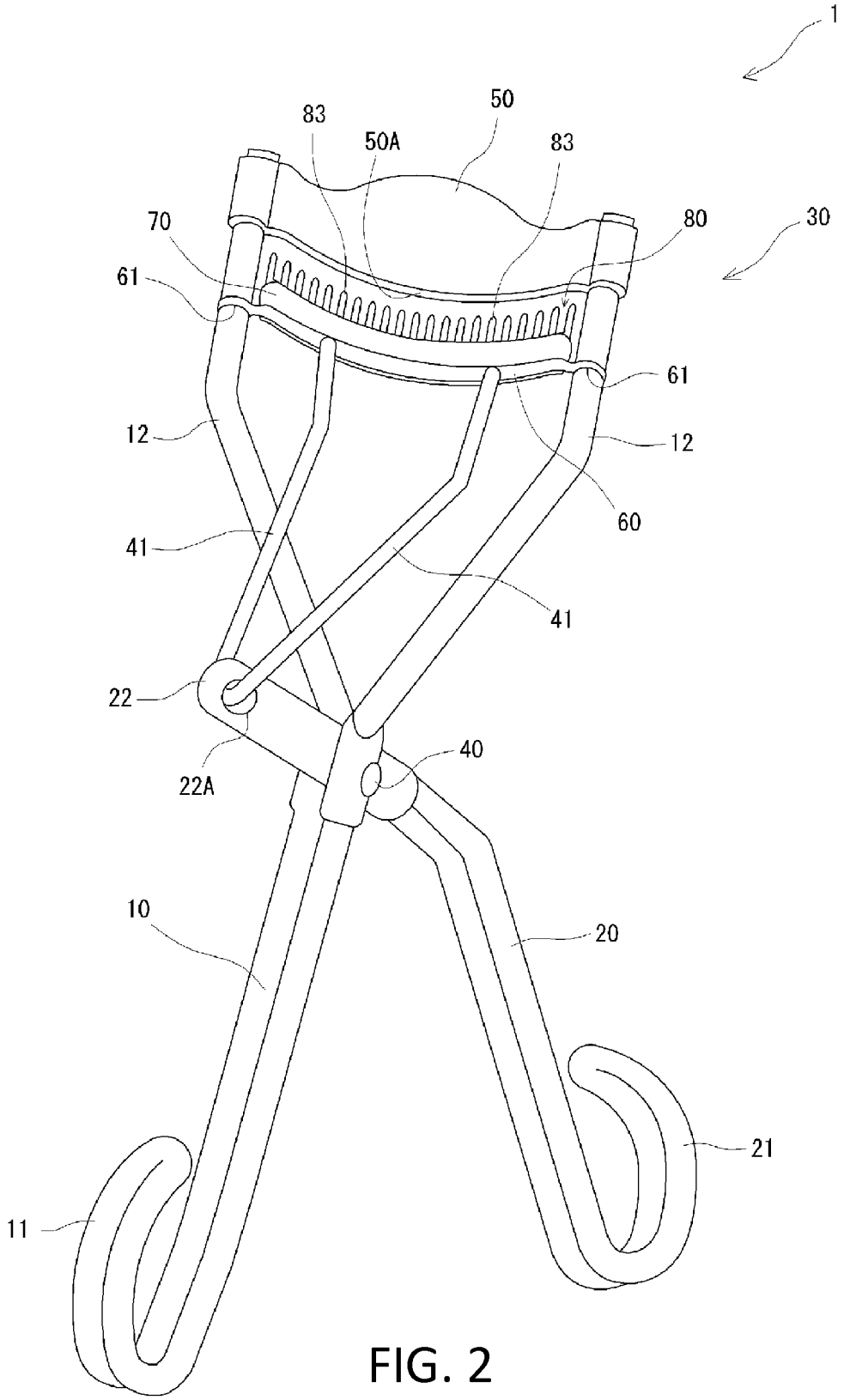
FIG. 2 is a perspective view of the eyelash curler shown in FIG. 1 as viewed from a rear side of the eyelash curler.

FIG. 1 is a front view showing an eyelash curler 1 according to an embodiment of the present invention, and FIG. 2 is a perspective view of the eyelash curler 1 shown in FIG. 1 as viewed from a rear side of the eyelash curler 1. As shown in FIGS. 1 and 2, the eyelash curler 1 of the present embodiment includes a first arm member 10 having a handle portion 11, for example, into which a thumb is inserted, a second arm member 20 having a handle portion 21, for example, into which a forefinger is inserted, and a curler portion 30 for curling eyelashes. The first arm member 10 and the second arm member 20 are pivotally supported by a shaft. Furthermore, the first arm member 10 includes a pair of frame portions 12 and 12, which bifurcate at the shaft 40 and extend upward.

As shown in FIGS. 1 and 2, the curler portion 30 includes a stationary member 50 attached to upper ends of the frame portions 12 and 12, a movable member 60 disposed below the stationary member 50, an elastic member 70 made of rubber or the like and disposed on the movable member 60, and a comb member 80 (additional member for an eyelash curler) disposed outside of a front surface of the movable member 60. The stationary member 50 connects the two frame portions 12 and 12 to each other, and a lower end 50A of the stationary member 50 serves to press eyelashes between the lower end 50A of the stationary member 50 and the elastic member 70 for curling the eyelashes.

As with the stationary member 50, the movable member 60 connects the two frame portions 12 and 12 to each other. The movable member 60 is configured to be slidable in a vertical direction along the frame portions 12 and 12. Specifically, the movable member 60 has insertion holes 61 and 61 formed at opposite ends of the movable member 60, and the frame portions 12 and 12 are inserted into those insertion holes 61 and 61, respectively. Thus, the movable member 60 is slidable in a vertical direction along the frame portions 12 and 12.

Figure 3:
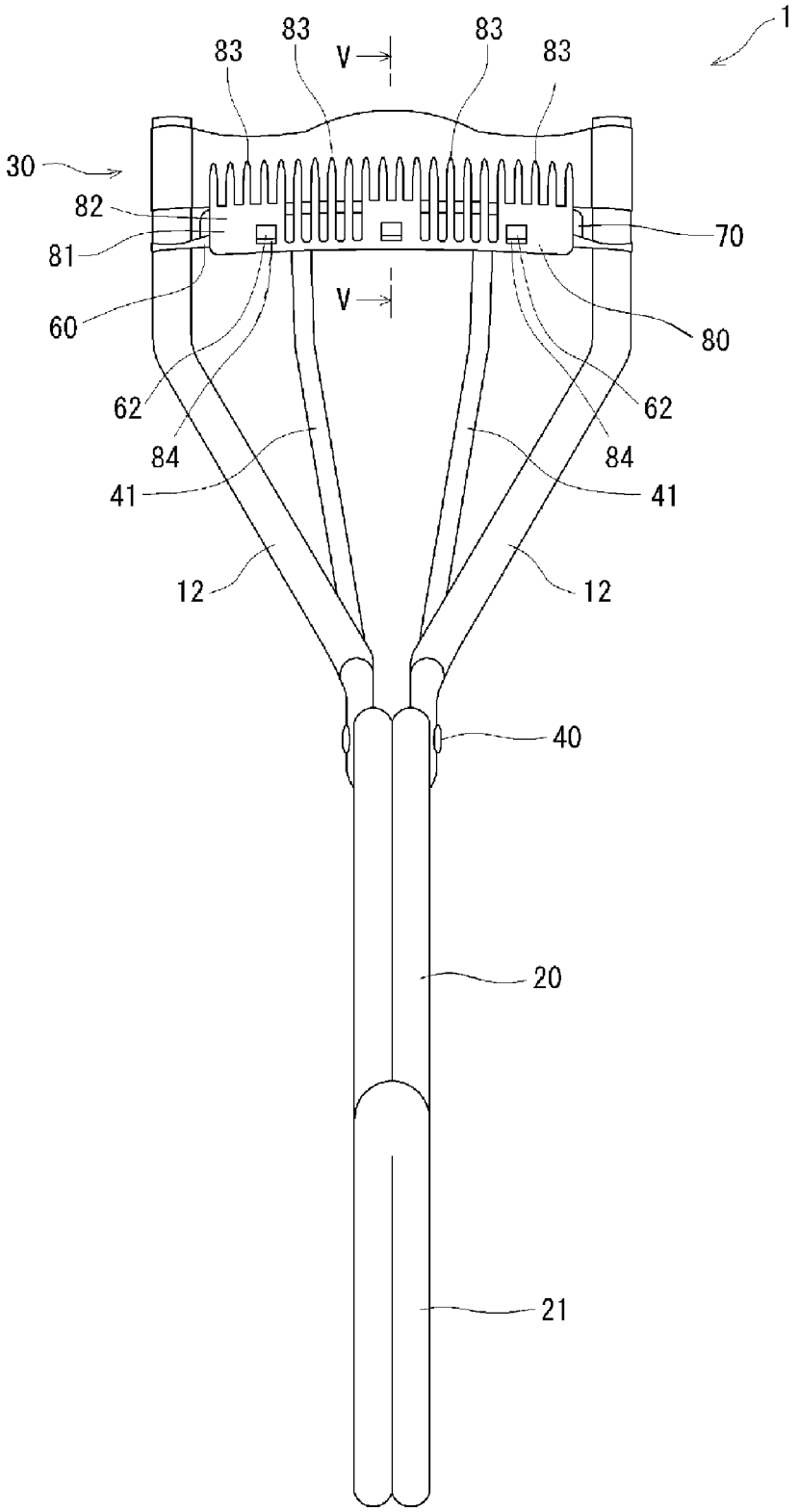
FIG. 3 is a front view of the eyelash curler shown in FIG. 1 when a movable member of the eyelash curler has been moved upward.
Figure 4:
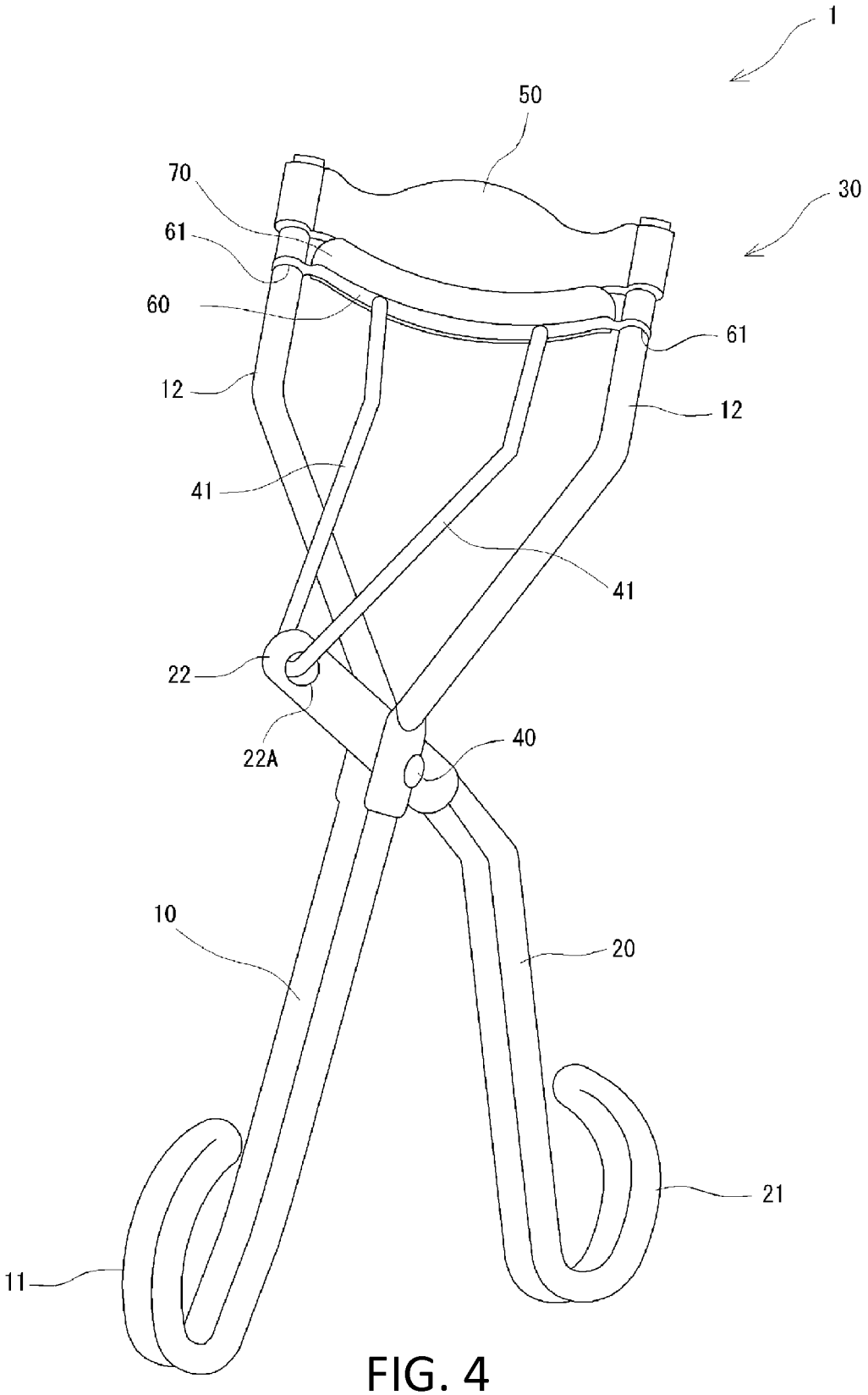
FIG. 4 is a perspective view of the eyelash curler shown in FIG. 3 as viewed from the rear side of the eyelash curler.

As shown in FIG. 2, a V-shaped connection member 41 is attached to a lower surface of the movable member 60. The connection member 41 is inserted into a through hole 22A formed in an upper end 22 of the second arm member 20. Therefore, as the second arm member 20 is moved about the shaft 40, the upper end 22 of the second arm member 20 is moved in the vertical direction. Accordingly, the movable member 60 is pushed up or pulled down. FIGS. 1 and 2 show a state in which the movable member 60 has been moved in a downward direction (open state). FIGS. 3 and 4 show a state in which the movable member 60 has been moved in an upward direction (close state).

Figure 5:
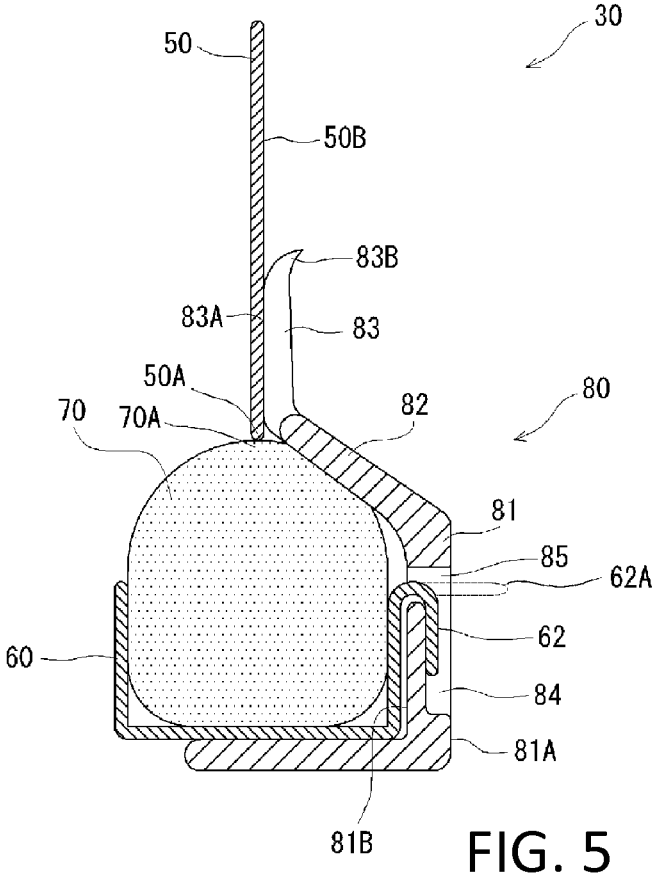
FIG. 5 is a cross-sectional view of a curler portion of the eyelash curler taken along line V-V of FIG. 3.

FIG. 5 is a cross-sectional view of the curler portion 30 of the eyelash curler 1 taken along line V-V of FIG. 3. As shown in FIG. 5, in the state in which the movable member 60 has been moved in the upward direction (into the close state), an upper end 70A of the elastic member 70 disposed on the movable member 60 contacts with the lower end 50A of the stationary member 50. Specifically, the elastic member 70 has a contact area 70A that is brought into contact with the lower end 50A of the stationary member 50 when the second arm member 20 is operated to move the movable member 60 in the upward direction. Thus, in this embodiment, the second arm member 20, the shaft 40, and the connection member 41 jointly form an operation portion operable to move the movable member 60 in the upward direction to bring the contact area 70A of the elastic member 70 into contact with the stationary member 50. When the eyelash curler 1 is used, eyelashes are sandwiched between the contact area 70A of the elastic member 70 and the stationary member 50 and are thus curled.

Figure 6:
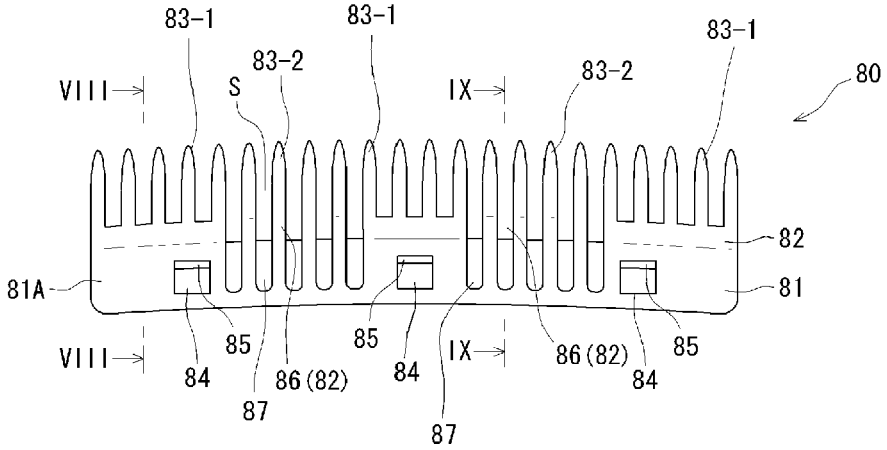
FIG. 6 is a front view of a comb member of the eyelash curler shown in FIG. 1.
Figure 7:
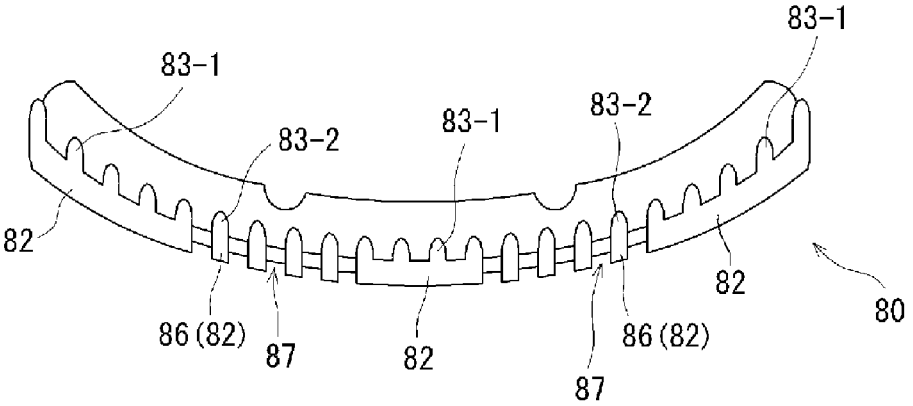
FIG. 7 is a plan view of the comb member shown in FIG. 6.

FIG. 6 is a front view of the comb member 80, and FIG. 7 is a plan view of the comb member 80. For example, the comb member 80 is formed of resin. The comb member 80 roughly has an arcuate shape in the plan view of FIG. 7. The comb member 80 covers part of a front surface and a bottom of the movable member 60. As shown in FIGS. 5 to 7, the comb member 80 includes an attachment portion 81 extending roughly in a vertical direction, a bridge portion 82 extending obliquely in an upward direction from an upper end of the attachment portion 81, and a plurality of tooth-shaped portions 83 (83-1 and 83-2) extending upward from an upper end of the bridge portion 82. The attachment portion 81 is attached to the front surface of the movable member 60. The tooth-shaped portions 83 are spaced at certain intervals (for example, about 0.5 mm to about 1.0 mm) in a horizontal direction. As shown in FIG. 5, the bridge portion 82 extends to the vicinity of the contact area 70A of the elastic member 70. Thus, the upper end of the bridge portion 82 is located near the contact area 70A of the elastic member 70. For example, about 15 to about 35 tooth-shaped portions 83 are provided.

In this manner, according to the present embodiment, a plurality of tooth-shaped portions 83 extend upward from a portion of the bridge portion 82 that is located near the contact area 70A of the elastic member 70. Therefore, when the eyelash curler is used, those tooth-shaped portions 83 forcibly go into between roots of eyelashes that are to be sandwiched between the contact area 70A of the elastic member 70 and the stationary member 50. Thus, the eyelashes can be separated finely at the roots thereof. Accordingly, the eyelashes do not adhere to each other. As a result, the eyelashes can be curled beautifully from the roots thereof. Furthermore, a plurality of tooth-shaped portions 83, which extend in parallel to each other, are spaced at certain intervals in the horizontal direction. Therefore, the tooth-shaped portions 83 are readily introduced into between eyelashes, so that the eyelashes can be curled into good-looking fan shapes. Moreover, the comb member 80 with such tooth-shaped portions 83 is attached to the outside of the movable member 60. Therefore, the comb member 80 can be seen from the outside of the eyelash curler 1. Thus, the advantageous effect of finely separating eyelashes can visually be appealed to users.

As shown in FIGS. 5 and 6, the attachment portion 81 of the comb member 80 has a plurality of recesses 84 (three recesses 84 in the illustrated example) formed in the front surface 81A and spaced at certain intervals in the horizontal direction. Furthermore, a through hole 85 is formed in an upper area of each of the recesses 84 so as to extend through the comb member 80 to a rear surface 81B of the attachment portion 81. Meanwhile, as shown in FIG. 5, the movable member 60 is provided with hook portions 62, which correspond to the recesses 84 and the through holes 85 of the comb member 80. Those hook portions 62 can be bent with a tool. FIG. 5 shows that one of the hook portions 62 has been bent downward.

When the comb member 80 is attached to the movable member 60, the hook portions 62 are first inserted into the through holes 85 of the comb member 80 (as shown by the dotted line 62A of FIG. 5). Then the hook portions 62 are bent downward so that each of the hook portion 62 is received within the corresponding recess 84. Thus, each of the hook portions 62 of the movable member 60 is held in engagement with a wall of the corresponding recess 84. Accordingly, the comb member 80 is fixed on the movable member 60.

In this manner, the hook portions 62 of the movable member 60 are inserted into the through holes 85 of the attachment portion 81 of the comb member 80 and then held in engagement with the attachment portion 81. Therefore, the comb member 80 can firmly be fixed on the movable member 60 in a stable manner. Accordingly, the eyelash curler 1 faces no risk that, for example, the comb member 80 staggers such that the tooth-shaped portions 83 or the like sticks in the user's eye when the eyelash curler 1 is used. The numbers and positions of the recesses 84, the through holes 85, and the hook portions 62 are not limited to those in the illustrated example. It is preferable to attach the comb member 80 to the movable member 60 by a method of attaching the comb member 80 to the movable member 60 without use of the hook portions 62 or the through holes 85 if possible. Furthermore, the comb member 80 may be attached to the movable member 60 in a detachable manner.

As shown in FIG. 5, each of the tooth-shaped portions 83 has a contact surface 83A that is substantially brought into contact with a front surface 50B of the stationary member 50 when the contact area 70A of the elastic member 70 is brought into contact with the stationary member 50. (For example, no gap is formed between the contact surface 83A and the front surface 50B of the stationary member 50, or, if a gap is formed between the contact surface 83A and the front surface 50B of the stationary member 50, such a gap is not more than 0.3 mm.) Thus, the tooth-shaped portions 83 of the comb member 80 are located so close to the stationary member 50 that the contact surfaces 83A are substantially brought into contact with the stationary member 50. Therefore, the tooth-shaped portions 83 are positioned very close to roots of eyelashes when the eyelashes are sandwiched between the stationary member 50 and the elastic member 70. Accordingly, the aforementioned effect of separating eyelashes at roots thereof can be exhibited more significantly.

Furthermore, as shown in FIG. 5, each of the tooth-shaped portions 83 has an upper end 83B curved forward from the front surface 50B of the stationary member 50. Since the upper end 83B of each of the tooth-shaped portions 83 is curved forward, the eyelash curler 1 faces no risk that tips of the tooth-shaped portions 83 stick in the user's eye when the eyelash curler 1 is used. Furthermore, when the movable member 60 is moved upward, the stationary member 50 is guided by curved surfaces of the upper ends 83B of the tooth-shaped portions 83. Therefore, the stationary member 50 is prevented from being caught on the tips of the tooth-shaped portions 83. For example, the upper ends 83B of the tooth-shaped portions 83 may be curved forward at an angle of about 15 degrees to about 20 degrees with respect to the contact surface 83A. For example, the curved upper ends 83B may have a length of about 0.5 mm to about 1.5 mm.

Figure 8:
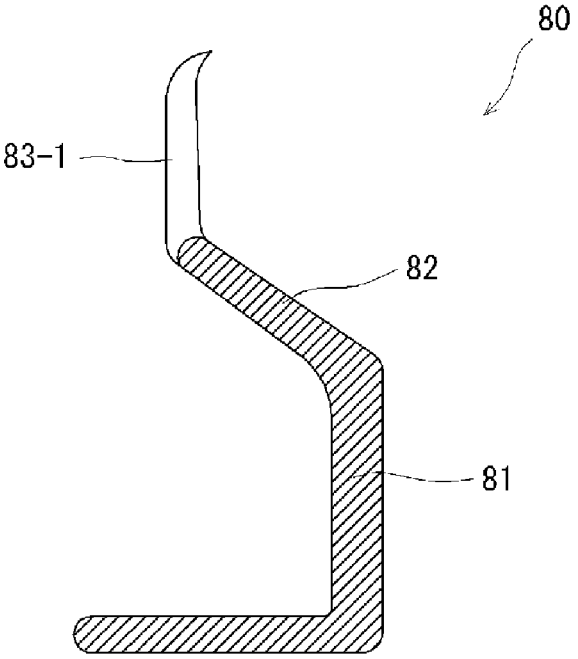
FIG. 8 is a cross-sectional view showing the comb member taken along line VIII-VIII of FIG. 6.
Figure 9:
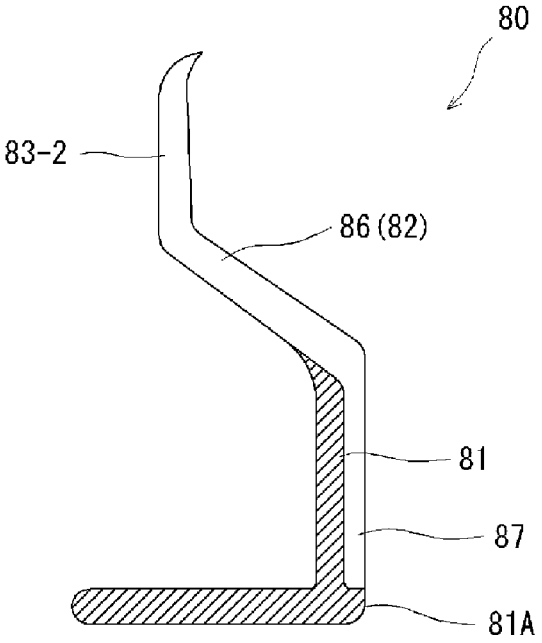
FIG. 9 is a cross-sectional view of the comb member taken along line IX-IX of FIG. 6.

FIG. 8 is a cross-sectional view showing the comb member 80 taken along line VIII-VIII of FIG. 6. FIG. 8 shows the vicinity of a tooth-shaped portion 83-1 (first tooth-shaped portion) of the tooth-shaped portions 83 that is formed at a position that is relatively close to the recess 84. FIG. 9 is a cross-sectional view showing the comb member 80 taken along line IX-IX of FIG. 6. FIG. 9 shows the vicinity of a tooth-shaped portion 83-2 (second tooth-shaped portion) of the tooth-shaped portions 83 that is formed at a position that is relatively far from the recess 84. As shown in FIGS. 6 and 8, at positions that are relatively close to the recesses 84, the bridge portion 82 extends entirely from the upper end of the attachment portion 81 to root portions of the first tooth-shaped portions 83-1 in order to ensure the strength and the stiffness of the attachment portion 81.

In contrast, as shown in FIGS. 6 and 9, at root portions of the second tooth-shaped portions 83-2 formed at positions that are relatively far from the recesses 841, part of the bridge portion 82 is removed along the second tooth-shaped portions 83-2 so as to extend slits S formed between adjacent tooth-shaped portions 83 (see FIG. 6) in the downward direction. Thus, tooth extension portions 86 are formed so as to extend continuously in the downward direction from the second tooth-shaped portions 83-2. The second tooth-shaped portion 83-2 and the tooth extension portion 86 jointly form a tooth-shaped portion that is longer than the first tooth-shaped portion 83-1. In this manner, part the bridge portion 82 is removed from both sides of each of the tooth extension portions 86. Therefore, in areas where the second tooth-shaped portions 83-2 are formed, a user can see the other side of the comb member 80 (the rear side of the paper of FIG. 6; the left side of FIG. 9) at a lower height than the user can see in areas where the first tooth-shaped portions 83-1 are formed. For example, the second tooth-shaped portions 83-2 may have a length of about 3 mm to about 5 mm.

Furthermore, grooves 87 are formed in the front surface 81A of the attachment portion 81 so as to extend downward along extension lines of the aforementioned slits S. Thus, in the areas where the second tooth-shaped portions 83-2 are formed, the thickness of the comb member 80 is locally reduced as compared to that in the areas where the first tooth-shaped portions 83-1 are formed (see FIG. 7).

It is preferable to allow a user to see between the elastic member 70 and the stationary member 50 in order to confirm that eyelashes are correctly sandwiched between the elastic member 70 and the stationary member 50 when the eyelash curler 1 is used. However, a user's view may be blocked by the comb member 80 if the comb member 80 has a large thickness or if the root portions of the tooth-shaped portions 83 of the comb member 80 has a large height. Theoretically, therefore, the comb member 80 should have the smallest possible thickness, and the root portions of the tooth-shaped portions 83 should have the lowest possible height (i.e., the tooth-shaped portions 83 should have the greatest possible length). On the other hand, if the comb member 80 is excessively thin or if the height of the root portions of the tooth-shaped portions 83 is excessively low, then the strength and the stiffness of the comb member 80 may be lowered so as to cause adverse effects including difficulty in attaching or fixing the comb member 80 to the movable member 60 and readiness of breakage of the comb member 80.

From this point of view, according to the present embodiment, in the areas where the first tooth-shaped portions 83-1 are formed, no part of the bridge portion 82 is removed, or no grooves such as the grooves 87 are formed in the attachment portion 81. Accordingly, the strength and the stiffness of the comb member 80 can be enhanced. In the areas where the second tooth-shaped portions 83-2 are formed, part of the bridge portion 82 is removed to form tooth extension portions 86, and the grooves 87 are formed in the attachment portion 81. Accordingly, a user can readily see between the elastic member 70 and the stationary member 50 (roots of eyelashes) when the eyelash curler 1 is used. Specifically, since the tooth extension portions 86 or the grooves 87 are formed only at part of the comb member 80, the height or thickness of the comb member 80 can locally be adjusted. Therefore, the visibility in use can be improved while the strength and the stiffness of the comb member 80 are maintained. If the comb member 80 can be attached to the movable member 60 without use of the hook portions 62 or the through holes 85 as described above, no through holes 85 need to be formed in the attachment portion 81. Accordingly, all of the tooth-shaped portions 83 can be formed into a long shape such as the second tooth-shaped portions 83-2. In such a case, eyelashes can more readily be seen when the eyelash curler 1 is used.

In the aforementioned embodiment, the comb member 80 is attached to the front surface of the movable member 60. Nevertheless, embodiments of the present invention are not limited to this example. The comb member 80 may be attached to a rear surface of the movable member 60 or within the movable member 60.

Although a preferred embodiment of the present invention has been described above, the present invention is not limited to the above embodiment. It should be understood that the present invention may be implemented in a wide variety of forms within the scope of the technical concept of the present invention.

INDUSTRIAL APPLICABILITY

The present invention is suitably used for an eyelash curler for curling eyelashes.

DESCRIPTION OF REFERENCE NUMERALS AND SIGNS

1 Eyelash curler
10 First arm member
11 Handle portion
12 Frame portion
20 Second arm member
21 Handle portion
30 Curler portion
40 Shaft
41 Connection member
50 Stationary member
50A Lower end
50B Front surface
60 Movable member
61 Insertion hole
62 Hook portion
62A Dotted line
70 Elastic member
70A Contact area
80 Comb member (additional member for eyelash curler)
81 Attachment portion
81A Front surface
81B Rear surface
82 Bridge portion
83 Tooth-shaped portion
83A Contact surface
83B Upper end
84 Recess
85 Through hole
86 Tooth extension portion
87 Groove
S Slit

The invention claimed is:

1. An additional member attached to an eyelash curler having a movable member operable to move in a vertical direction and a stationary member fixed above the movable member, wherein an elastic member is attachable to the movable member, the elastic member having a contact area that is brought into contact with the stationary member, the additional member comprising:

an attachment portion attachable to the movable member;

a bridge portion extending obliquely in an upward and backward direction from the attachment portion; and a plurality of upright tooth-shaped separators extending upward in the vertical direction from an upper end of the bridge portion that extends obliquely in an upward and backward direction, the plurality of tooth-shaped separators being spaced at certain intervals in a horizontal direction, wherein:

each of the plurality of tooth-shaped separators has a tapered upper end for separating eyelashes from each other, and the plurality of upright tooth-shaped separators are operable to move in the vertical direction responsive to the movable member being moved in the vertical direction;

the stationary member includes a lower end configured to engage with curved upper ends of the plurality of tooth-shaped separators to prevent the stationary member from being caught on tips of the tooth-shaped separators, and to prevent the tips of the tooth-shaped separators from sticking in a user's eye;

a through hole is formed in the attachment portion so as to extend from a front surface of the attachment portion to a rear surface of the attachment portion;

the movable member includes a hook portion inserted into the through hole and held in engagement with the attachment portion;

the elastic member sits in the movable member between sidewalls of the movable member and in direct contact with the sidewalls of the movable member;

the elastic member is in direct contact with the bridge portion;

the hook portion is adjacent to the elastic member;

the hook portion is disposed beneath the bridge portion;

the contact area of the elastic member is at a top center location of the elastic member;

the movable member is configured to bring the elastic member into contact with the stationary member at the top center location of the elastic member;

each of the plurality of tooth-shaped separators has a contact surface along substantially an entire length of each of the plurality of tooth-shaped separators thereof; and the contact surface of each of the plurality of tooth-shaped separators is configured to substantially be brought into contact with a front surface of the stationary member responsive to the contact area of the elastic member being brought into contact with the stationary member.

2. The additional member for an eyelash curler as recited in claim 1, wherein the tapered upper end of each of the plurality of tooth-shaped separators is curved forward from the front surface of the stationary member such that the stationary member is configured to be guided by the curved forward tapered upper end of each of the plurality of tooth-shaped separators to prevent the stationary member from being caught on the tips of the tooth-shaped separators, and to prevent the tips of the tooth-shaped separators from sticking in the user's eye.

3. The additional member for an eyelash curler as recited in claim 2, wherein the tapered upper end of each of the plurality of tooth-shaped separators is curved forward at an angle of about 15 degrees to about 20 degrees.

4. The additional member for an eyelash curler as recited in claim 2, wherein an edge portion of each of the plurality of tooth-shaped separators faces at least one other edge portion of a tooth-shaped separator from among the plurality of tooth-shaped separators, and wherein a flat portion of each of the plurality of tooth-shaped separators is configured to face the user's eye.

5. The additional member for an eyelash curler as recited in claim 1, further comprising a tooth extension portion formed so as to extend continuously in a downward direction from the tooth-shaped separator by removal of part of the bridge portion along adjacent tooth-shaped separators so as to extend a slit formed between the adjacent tooth-shaped separators in the downward direction.

6. The additional member for an eyelash curler as recited in claim 5, wherein a groove is formed in the attachment portion so as to extend in the downward direction along an extension line of the slit.

7. An eyelash curler comprising:

a pair of frame portions extending in a vertical direction;

a movable member connecting between the pair of frame portions, the movable member being movable in the vertical direction along the pair of frame portions;

a stationary member connecting between the pair of frame portions, the stationary member being fixed above the movable member;

an elastic member placed on the movable member, the elastic member having a contact area that is brought into contact with the stationary member;

an operation portion operable to move the movable member upward to bring the contact area of the elastic member into contact with the stationary member; and a comb member attached to the movable member, the comb member including:

an attachment portion attached to the movable member, a bridge portion extending from the attachment portion to near the contact area of the elastic member, and a plurality of upright tooth-shaped separators extending upward in the vertical direction from the bridge portion so that at least lower ends of the tooth-shaped separators are substantially brought into direct contact with the stationary member when the contact area of the elastic member is brought into contact with the stationary member, the plurality of tooth-shaped separators being spaced at certain intervals in a horizontal direction, wherein:

each of the plurality of tooth-shaped separators has a tapered upper end for separating eyelashes from each other, and the plurality of upright tooth-shaped separators are operable to move in the vertical direction responsive to the movable member being moved in the vertical direction;

the stationary member includes a lower end configured to engage with curved upper ends of the plurality of tooth-shaped separators of the comb member to prevent the stationary member from being caught on tips of the tooth-shaped separators, and to prevent the tips of the tooth-shaped separators from sticking in a user's eye;

a through hole is formed in the attachment portion of the comb member so as to extend from a front surface of the attachment portion to a rear surface of the attachment portion;

the movable member includes a hook portion inserted into the through hole and held in engagement with the attachment portion of the comb member;

the elastic member sits in the movable member between sidewalls of the movable member and in direct contact with the sidewalls of the movable member;

the elastic member is in direct contact with the bridge portion;

the hook portion is adjacent to the elastic member;

the hook portion is disposed beneath the bridge portion;

the contact area of the elastic member is at a top center location of the elastic member;

the movable member is configured to bring the elastic member into contact with the stationary member at the top center location of the elastic member;

each of the plurality of tooth-shaped separators of the comb member has a contact surface along substantially an entire length of each of the plurality of tooth-shaped separators thereof; and the contact surface of each of the plurality of tooth-shaped separators is configured to substantially be brought into contact with a front surface of the stationary member responsive to the contact area of the elastic member being brought into contact with the stationary member.

8. The eyelash curler as recited in claim 7, wherein the tapered upper end of each of the plurality of tooth-shaped separators of the comb member is curved forward from the front surface of the stationary member such that the stationary member is configured to be guided by the curved forward, tapered upper end of each of the plurality of tooth-shaped separators to prevent the stationary member from being caught on the tips of the tooth-shaped separators, and to prevent the tips of the tooth-shaped separators from sticking in the user's eye.

9. The eyelash curler as recited in claim 7, wherein the comb member is attached to an outside of the movable member.

10. The eyelash curler as recited in claim 7, wherein the comb member further includes a tooth extension portion formed so as to extend continuously in a downward direction from the tooth-shaped separator by removal of part of the bridge portion of the comb member along adjacent tooth-shaped separators so as to extend a slit formed between the adjacent tooth-shaped separators in the downward direction.

11. The eyelash curler as recited in claim 10, wherein a groove is formed in the attachment portion of the comb member so as to extend in the downward direction along an extension line of the slit.

12. The eyelash curler as recited in claim 7, wherein an edge portion of each of the plurality of tooth-shaped separators faces at least one other edge portion of a tooth-shaped separator from among the plurality of tooth-shaped separators, and wherein a flat portion of each of the plurality of tooth-shaped separators is configured to face the user's eye.

* * * * *